US006155854A

United States Patent [19]

Chen

[11] Patent Number: 6,155,854

[45] Date of Patent: Dec. 5, 2000

[54] AUDIO JACK WITH IMPROVED TRANSFER SWITCH

[75] Inventor: Richard Chen, Tu-Chen, Taiwan

[73] Assignee: Hon Hai Precision Inc. Co., Ltd., Taipei Hsien, Taiwan

[21] Appl. No.: 09/395,877

[22] Filed: Sep. 14, 1999

[30] Foreign Application Priority Data

Oct. 17, 1998 [TW] Taiwan ..... 87217144

[51] Int. Cl.[7] ..... H01R 29/00

[52] U.S. Cl. ..... 439/188

[58] Field of Search ..... 439/188, 944

[56] References Cited

U.S. PATENT DOCUMENTS 5,338,215 8/1994 Lee et al. ..... 439/188

5,803,757 9/1998 Wang ..... 439/188

5,893,767 4/1999 Broschard, III ..... 439/188

*Primary Examiner*—Gary F. Paumen

*Attorney, Agent, or Firm*—We Te Chung

[57] ABSTRACT

An audio jack comprises an insulative housing, a plug receptacle projecting from the housing for mating with a complementary audio plug, and a pair of transfer switches retained in the housing and extending therefrom for connecting to a circuit board. Each transfer switch consists of an engagement contact and a resilient contact engageable with the engagement contact. Each resilient contact comprises a contact portion with a wiping contact section formed thereon engageable with the corresponding engagement contact. A wiping contact action between the resilient contact and the corresponding engagement contact is complemented by the design of the wiping contact section to remove contaminants on the contact interface thereby ensuring a reliable connection therebetween.

1 Claim, 6 Drawing Sheets

AUDIO JACK WITH IMPROVED TRANSFER SWITCH

BACKGROUND OF THE INVENTION

The present invention relates to an audio jack, and more particularly to a transfer switch for an audio jack consisting of a resilient contact and an engagement contact having a wiping contact therebetween for ensuring reliable contact.

Description of Prior Art

Multi-media devices are commonly attached to a computer, and audio jacks are popularly used in computers for providing the multi-media device with a connection port. An audio jack typically comprises an insulative housing, a plug receptacle projecting from the housing for receiving a complementary audio plug, and two transfer switches retained in the housing and downwardly extending therefrom for connecting to a printed circuit board. The normally closed transfer switch consists of a resilient contact for engaging with a mating contact of the complementary audio plug, and an engagement contact engaging with the resilient contact.

Among the problems which must be overcome for an audio jack to attain a satisfactory level of performance is that the audio jack must function in various environments, such as outdoors, where it is susceptible to environmental contaminants or where oxides may build up over time. The contaminants or oxides built up on a contact interface between the resilient contact and the engagement contact of the transfer switch may cause improper contact therebetween thereby interfering with signal transmission between the computer and the complementary audio plug. Since low electrical potential and current are applied to the audio jack, the energy present in power applications to burn off such contaminants or oxides is not available. Therefore, it is desirable to establish a wiping contact between the resilient contact and the engagement contact of the transfer switch to remove contaminants from the contact interface thereby ensuring signal transmission.

SUMMARY OF THE INVENTION

Accordingly, one object of the present invention is to provide an audio jack with an improved transfer switch for ensuring reliable signal transmission.

Another object of the present invention is to provide an audio jack with an improved transfer switch consisting of a resilient contact and an engagement contact, wherein the resilient contact has an additional contact section to effect a wiping contact with the engagement contact thereby ensuring a reliable connection therebetween.

In order to achieve the objects set forth, an audio jack in accordance with the present invention comprises an insulative housing, a plug receptacle projecting from the housing for receiving a complementary audio plug, and a pair of transfer switches retained in the housing and extending therefrom for connecting to a circuit board. Four juxtaposed grooves are disposed in a bottom portion of the housing each with a slot disposed in an end portion thereof. Each transfer switch consists of an engagement contact and a resilient contact engage able with the engagement contact. The engagement contact comprises a retention portion retained in the corresponding groove with a cutout disposed therein, and a termination portion extending through the corresponding slot for connecting to the circuit board. The resilient contact comprises a planar portion retained in the corresponding groove, a substantially U-shaped resilient portion engaging with a mating contact of the complementary audio plug, and a contact portion engaging with the corresponding engagement contact. The contact portion of the resilient contact further comprises a pair of trapezoidal wiping contact members extending from opposite longitudinal edges thereof for engaging with a periphery of the cutout of the corresponding engagement contact.

Each transfer switch is movable between a normally closed position and an open position. At the normally closed position, the resilient contact engages with the corresponding engagement contact by engaging the contact portion with the retention portion whereby the wiping contact members abut against the periphery of the cutout thereof. The resilient contact is helped to disengage from the corresponding engagement contact to the open position by the resilient portion being deflected upon engagement with the mating contact of the complementary audio plug. When the mating contact is removed, the resilient contact resumes its original shape whereby the transfer switch returns to the closed position. Since there is a wiping contact action between the resilient contact and the corresponding engagement contact, contaminants built up on contact interfaces are removed to ensure a reliable connection therebetween.

Other objects, advantages and novel features of the invention will become more apparent from the following detailed description when taken in conjunction with the accompanying drawings.

DETAILED DESCRIPTION OF THE INVENTION

Figure 1:
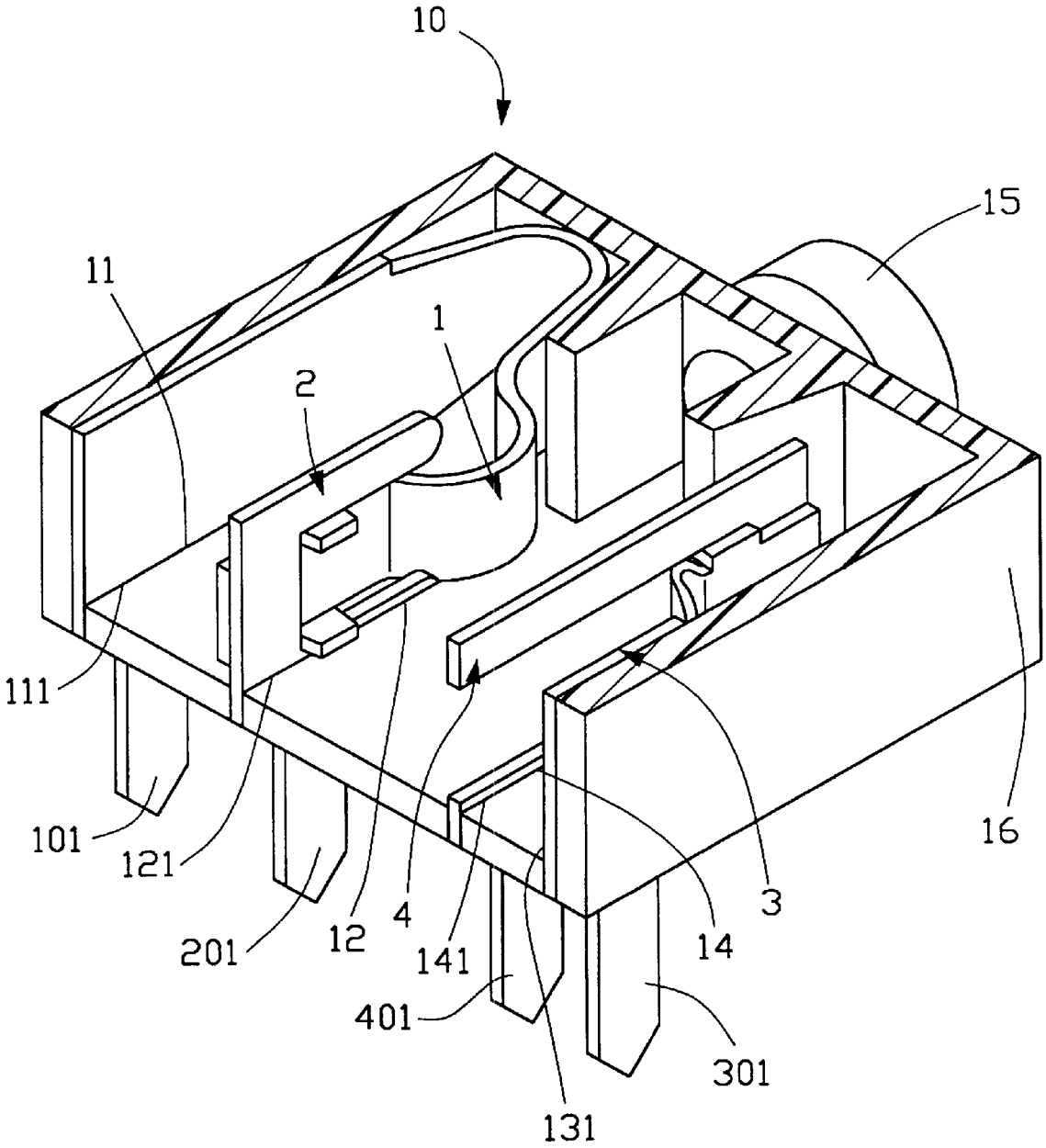
FIG. 1 is a perspective view of an audio jack in accordance with the present invention with its top cut away to reveal inner transfer switches.

Referring to FIG. 1, an audio jack 10 comprises an insulative housing 16, first and second normally closed transfer switches (not labeled) retained in the housing 16, and a plug receptacle 15 projecting from the housing 16 defining a cavity (not labeled) therein for receiving a complementary audio plug (not shown). The first transfer switch consists of a first engagement contact 2 and a first resilient contact 1 engageable with the first engagement contact 2, and the second transfer switch consists of a second engagement contact 4 and a second resilient contact 3 engageable with the second engagement contact 4.

Figure 2:
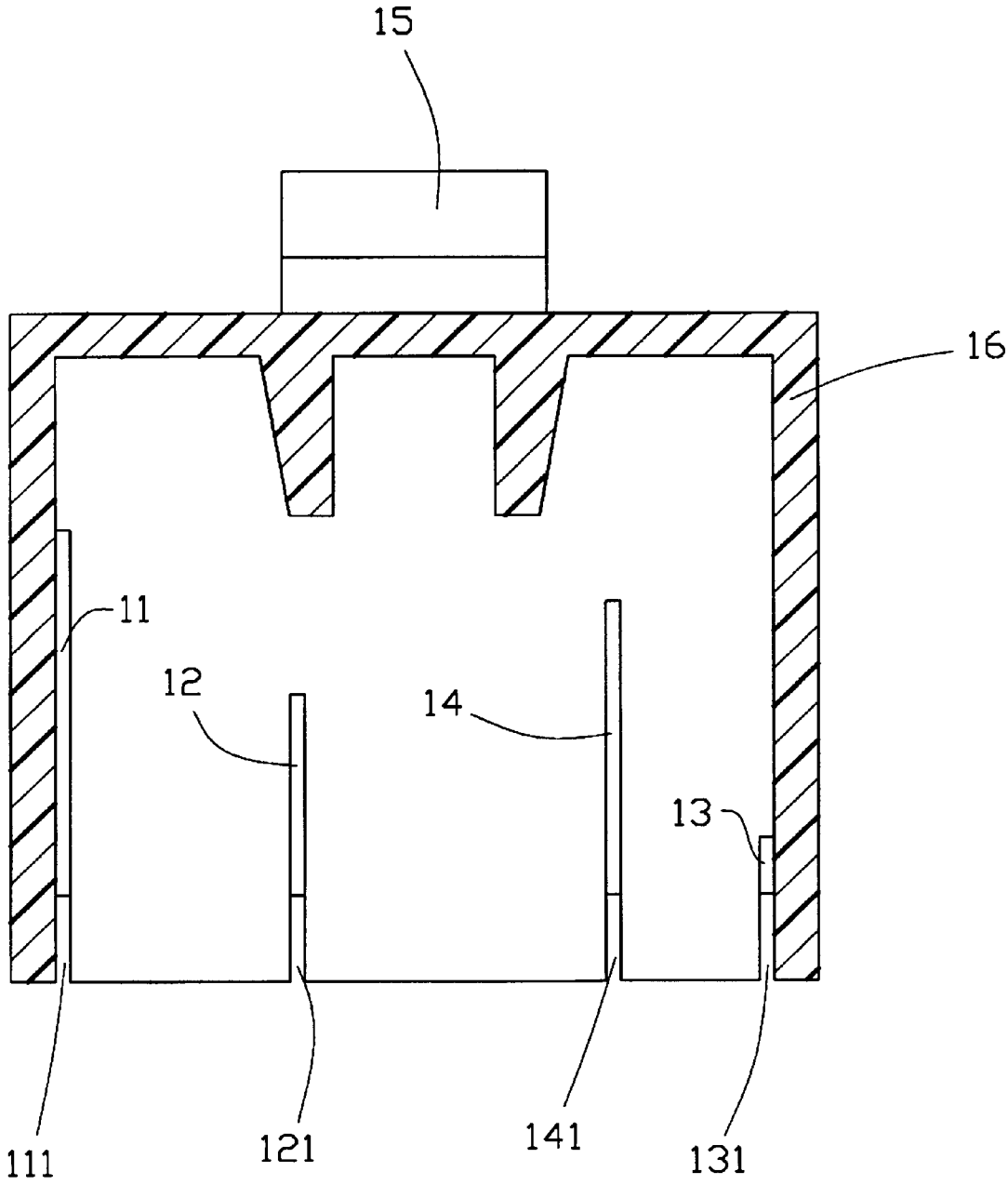
FIG. 2 is a top plan view of FIG. 1 with the inner transfer switches removed therefrom for clarity.
Figure 3:
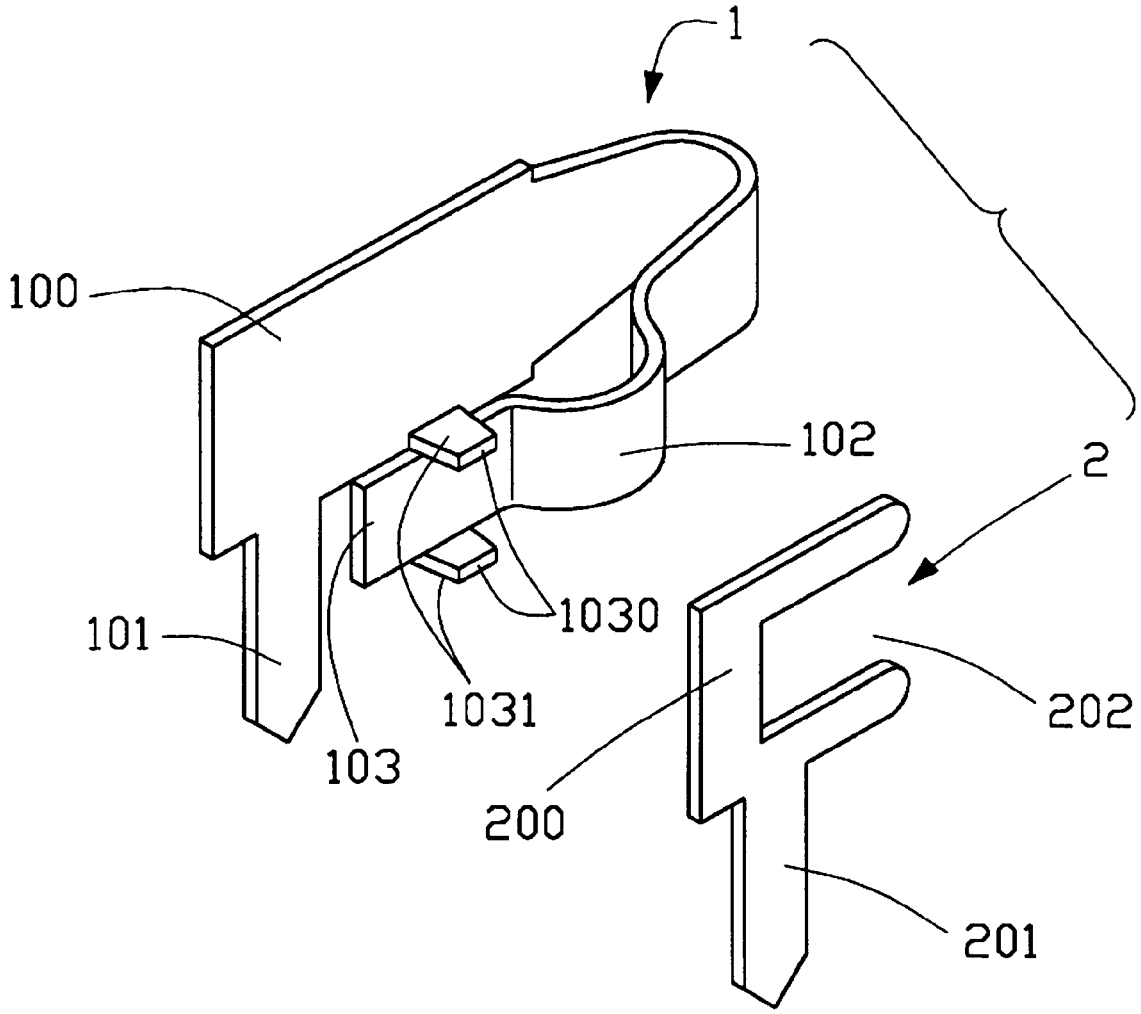
FIG. 3 is an exploded view of a first transfer switch.
Figure 4:
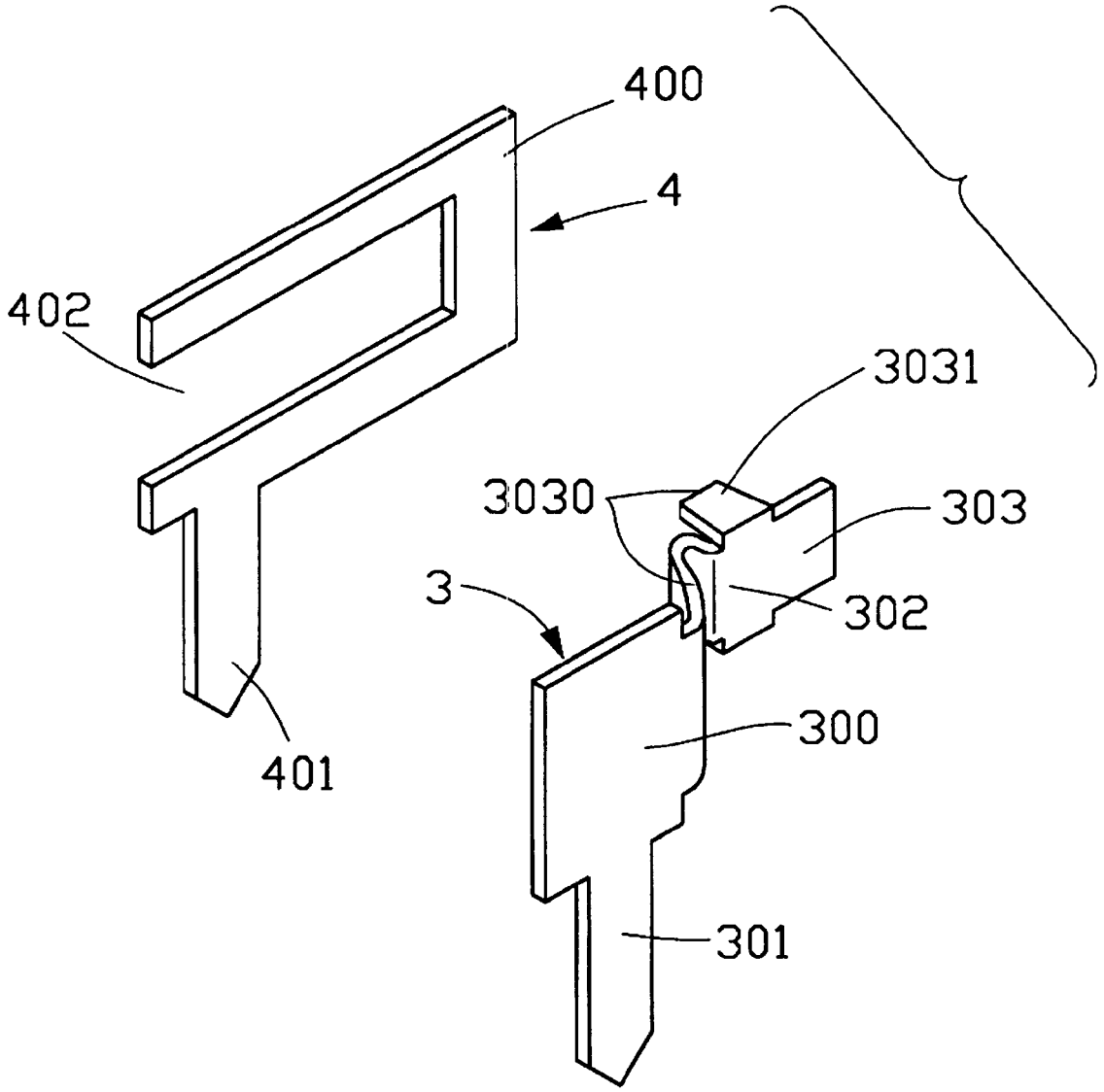
FIG. 4 is an exploded view of a second transfer switch.
Figure 5:
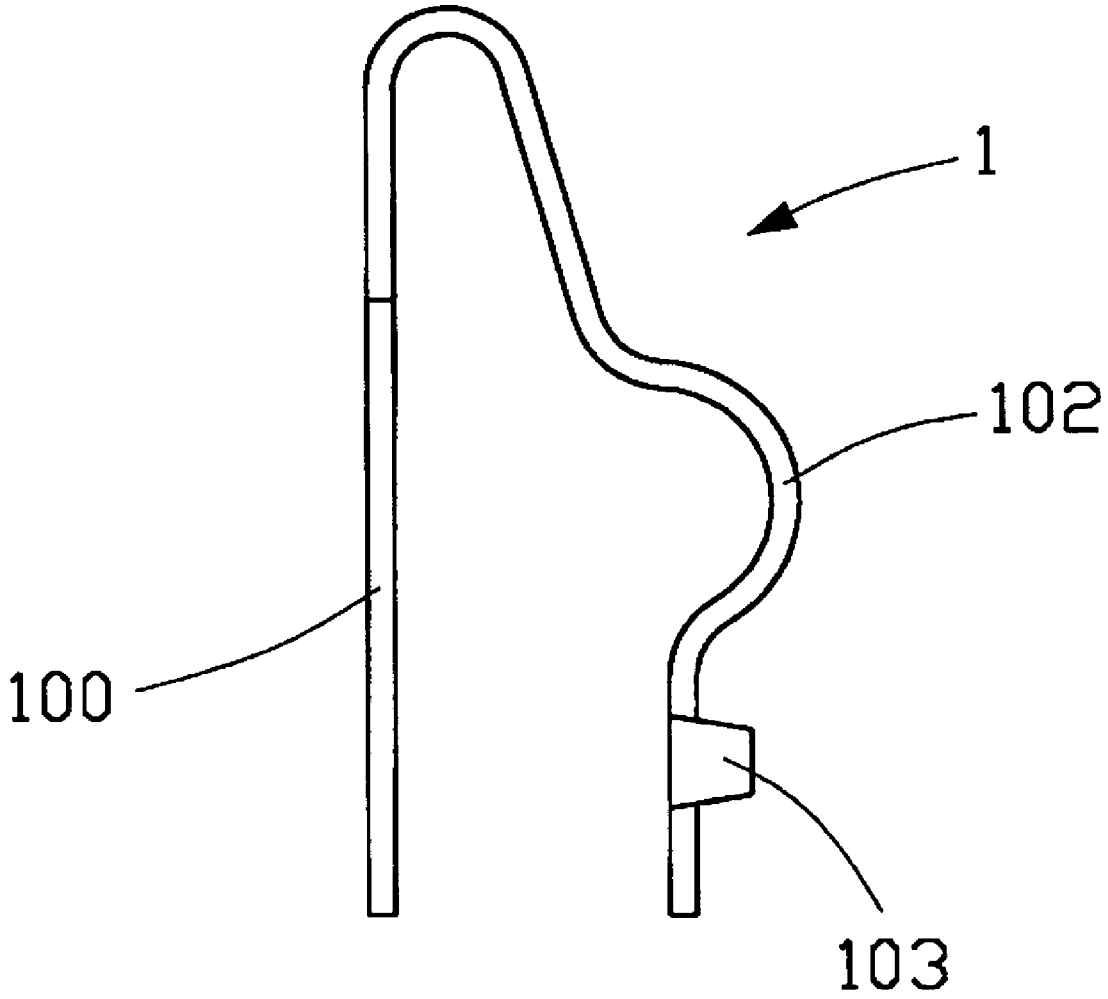
FIG. 5 is a top plan view of a first resilient contact of the first transfer switch.
Figure 6:
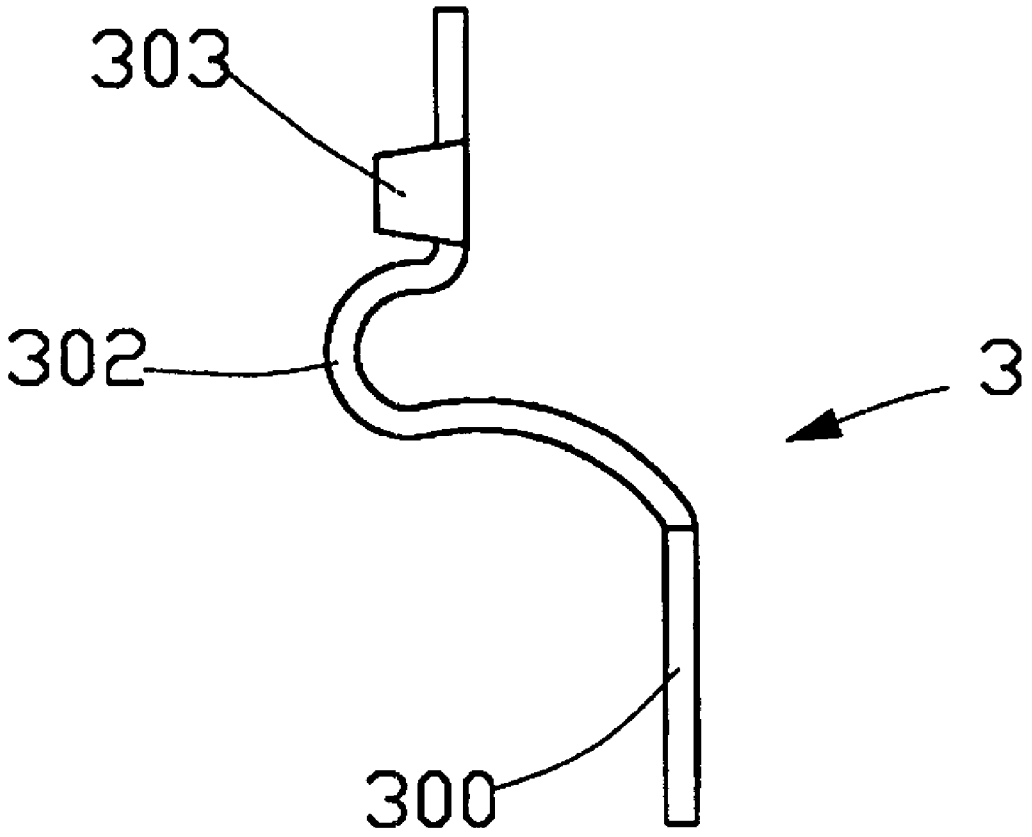
FIG. 6 is a top plan view of a second resilient contact of the second transfer switch.

Also referring to FIG. 2, the housing 16 is hollow and is in communication with the cavity of the plug receptacle 15. Four elongate grooves 11, 12, 13, 14 are formed in an upper surface of a bottom portion (not labeled) thereof and juxtaposed with each other for retaining the contacts 1, 2, 3, 4 in position. Each groove 11, 12, 13, 14 forms a slot 111, 121, 131, 141 disposed at an end portion thereof through the bottom portion of the housing 16 in a direction away from the plug receptacle 15. The contacts 1, 2, 3, 4 are retained in the grooves 11, 12, 13, 14 and downwardly extend from the slots 111, 121, 131, 141 for connecting to a printed circuit board (not shown).

Also referring to FIGS. 3 through 6, each of the first and second engagement contacts 2, 4 comprises a retention portion 200, 400 with a cutout 202, 402 disposed therein, and a termination portion 201, 401 extending from the retention portion 200, 400. The retention portions 200, 400 of the first and second engagement contacts 2, 4 are received in the grooves 12, 14 and are thereby retained in the housing 16. The termination portions 201, 401 of the first and second engagement contacts 2, 4 extend through the slots 121, 141 of the grooves 12, 14 for connecting to the printed circuit board.

Each of the first and second resilient contacts 1, 3 comprises a planar portion 100, 300 retained in the grooves 11, 13 of the housing 16, a substantially U-shaped resilient portion 102, 302 for engaging with a mating contact of the complementary audio plug, a contact portion 103, 303, and a tail portion 101, 301 extending through the slot 111, 131 of the groove 11, 13 for connecting to the circuit board. Each contact portion 103, 303 further comprises a wiping contact section in the form of a pair of trapezoidal wiping (or sliding) contact members 1030, 3030 integrally extending from opposite longitudinal edges thereof. Alternatively, the wiping contact section comprises a wiping contact member 1030, 3030 integrally extending from a lateral edge of each contact portion 103, 303, whereby the cutout 202, 402 of the engagement contact 2, 4 is formed in a lateral edge thereof. Each wiping contact member 1030, 3030 has a contact surface 1031, 3031 for contacting a periphery of the cutout 202, 402 of the engagement contact 2, 4. The wiping contact members 1030, 3030 are retained in the cutouts 202, 402 of the first and second engagement contacts 2, 4 when at a normally closed position. The resilient portions 102, 302 having high resiliency are adapted for disengaging the first and second resilient contacts 1, 3 from the first and second engagement contacts 2, 4 when an external force exerted by the mating contact of the complementary audio plug acts thereon.

At the normally closed position, the contact portions 103, 303 of the resilient contacts 1, 3 engage the corresponding retention portions 200, 400, with the wiping contact members 1030, 3030 projecting out of the cutouts 202, 402 of the engagement contacts 2, 4, as best seen in FIG. 1. When the mating contacts of the complementary audio plug engage with the resilient portions 102, 302 of the resilient contacts 1, 3, the resilient contacts 1, 3 are deflected rearward to an open position. At the open position, the resilient contacts 1, 3 are no longer in engagement with the engagement contacts 2, 4 thereby indicating that the audio plug is inserted into the plug receptacle 15 and engaged with the resilient portions 102, 302 of the resilient contacts 1, 3. When the audio plug is removed, the resilient portions 102, 302 resume their original shapes whereby the transfer switches return to the normally closed position.

The resilient portions 102, 302 and contact portions 103, 303 of the first and second resilient contacts 1, 3 are integrally stamped and formed by bending. The design of these contacts results in a wiping contact action between the wiping contact members 1030, 3030 and the peripheries of the cutouts 202, 402 for removing contaminants from the contact interfaces therebetween and ensuring reliability of the contact. Since the wiping contact portions 1030, 3030 are trapezoidal, they will not be locked in the cutouts 202, 402 when the force exerted during insertion of the audio plug acts to open the transfer switches, and they can successfully slide back into the cutouts 202, 402 to the closed position when the audio plug is removed.

Although only one form of wiping contact member 1030, 3030 is disclosed, it should be understood that other forms of the wiping contact members can also be employed to serve the same function. All such equivalent modifications are embodied in the present invention so long as a wiping contact action is effected between the resilient contacts 1, 3 and the engagement contacts 2, 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An audio jack mounted on a circuit board for mating with a complementary audio plug, comprising:

an insulative housing comprising a plug receptacle projecting from one end thereof for mating with the audio plug and a plurality of grooves each forming a slot at an opposite end thereof;

a pair of transfer switches retained in the housing, each switch comprising an engagement contact and a resilient contact, each contact being retained in a corresponding one of the grooves and having a termination portion downwardly extending through a corresponding one of the slots for connection to the circuit board, the resilient contact having a wiping contact section which slidingly engages with the engagement contact to a normally closed position, the closing and opening of the switch effecting a wiping contact action between the wiping contact section and the engagement contact;

wherein the engagement contact comprises a retention portion retained in the corresponding groove of the housing, and wherein the resilient contact comprises a contact portion at a free end thereof engaged with the retention portion of the associated engagement contact at the closed position, the wiping contact section extending from and edge of the contact portion of the resilient contact;

wherein the engagement contact comprises a cutout formed in the retention portion thereof, the wiping contact section of the resilient contact abutting against a periphery of the cutout at the closed position and disengaging from the periphery of the cutout at the open position;

wherein the wiping contact section of the resilient contact comprises a pair of wiping contact members integrally extending from opposite longitudinal edges thereof, each wiping contact member having a contact surface abutting against the periphery of the cutout of the associated engagement contact at the closed position;

wherein each wiping contact member of the resilient contact is trapezoidal for facilitating engagement and disengagement with the corresponding engagement contact.

* * * * *